US006761007B2

(12) United States Patent
Lancelot, III et al.

(10) Patent No.: US 6,761,007 B2
(45) Date of Patent: Jul. 13, 2004

(54) STRUCTURAL TIE SHEAR CONNECTOR FOR CONCRETE AND INSULATION COMPOSITE PANELS

(75) Inventors: Harry B. Lancelot, III, Centerville, OH (US); Sidney E. Francies, III, Springboro, OH (US)

(73) Assignee: Dayton Superior Corporation, Dayton, OH (US)

( * ) Notice: Subject to any disclaimer, the term of this patent is extended or adjusted under 35 U.S.C. 154(b) by 57 days.

(21) Appl. No.: 10/141,278

(22) Filed: May 8, 2002

(65) Prior Publication Data

US 2003/0208987 A1 Nov. 13, 2003

(51) Int. Cl.[7] ..... E04C 2/288
(52) U.S. Cl. ..... 52/426; 52/309.7; 52/565
(58) Field of Search ..... 52/309.1, 309.2, 52/426, 565, 797.1, 800.1, 309.11, 562, 712; 404/47; 14/73.1; 217/644, 645, 906

(56) References Cited

U.S. PATENT DOCUMENTS 4,117,639 A * 10/1978 Steenson et al. ..... 52/223.6
4,640,074 A * 2/1987 Paakkinen ..... 52/410
4,768,324 A * 9/1988 Hibbard ..... 52/742.14
4,879,855 A * 11/1989 Berrenberg ..... 52/309.11
5,440,845 A * 8/1995 Tadros et al. ..... 52/309.12
5,704,180 A * 1/1998 Boeck ..... 52/426
5,709,060 A * 1/1998 Vaughan et al. ..... 52/426
5,809,723 A * 9/1998 Keith et al. ..... 52/405.1
5,852,907 A * 12/1998 Tobin et al. ..... 52/714
5,896,714 A * 4/1999 Cymbala et al. ..... 52/426
6,088,985 A 7/2000 Clark ..... 52/309.11

* cited by examiner

*Primary Examiner*—Leslie A. Braun
*Assistant Examiner*—Jon Szumny
(74) *Attorney, Agent, or Firm*—Wood, Herron & Evans, L.L.P.

(57) ABSTRACT

A structural tie shear connector for use with a concrete and insulation composite panel. The panel has a first concrete wythe, a second concrete wythe, and an insulation layer interposed between the first and second concrete wythes. The connector has two sides extending in a direction substantially parallel to a longitudinal centerline of the connector and two sides extending across the longitudinal centerline of the connector. First and second pairs of angular links are connected to the sides, and a pair of legs are connected to, and extend outward from, one side of the connector. The connector is extendable through the insulation layer and into the first and second concrete wythes to hold the panel together.

30 Claims, 3 Drawing Sheets

STRUCTURAL TIE SHEAR CONNECTOR FOR CONCRETE AND INSULATION COMPOSITE PANELS

FIELD OF THE INVENTION

This invention relates generally to precast concrete and insulation composite panels in which a layer of insulation is sandwiched between exterior layers of concrete.

BACKGROUND OF THE INVENTION

Referring to FIG. 6, a known concrete and insulation composite panel 20 is composed of two layers or wythes of concrete 22, 24 separated by a layer of high density foam insulation 26 in the center. The thickness of the concrete wythes varies depending upon the structural requirements of the building. The most common load requirements include wind load, roof load, and seismic load. These loads must be collected and then transferred to the building frame and the building foundation. The two concrete wythes 22, 24 handle the majority of this work in concert. But, when the concrete wythes 22, 24 are separated by an insulation layer 26, one or more structural tie shear connectors 28 are used to connect the two concrete wythes together across the insulation layer in such a manner as to cause the two concrete wythes to function more as a single composite unit structurally. Such connectors 28 transfer load forces, for example, wind forces, imposed on one concrete wythe 22 across the insulation layer 26 and into the other concrete wythe 24. With the structural tie shear connector, the two concrete wythes act in concert to provide a singular load-resisting element greater than the sum capacities of the individual concrete layers. A concrete and insulation panel of the type described above is further shown and described in U.S. Pat. No. 6,088,985.

While such a connector 28 provides satisfactory performance, it is desirable that its performance be improved. For example, during the manufacturing process, an initial bond is created between the concrete wythes 22, 24 and insulation layer 26, but this bond is eventually broken due to handling, thermal differentials and cycling, or service loads. Therefore, the structural tie shear connectors 28 are solely responsible for maintaining the structural integrity of the panel 20. For example, the shear connectors 28 are effective to transfer forces between the wythes 22, 24 due to longitudinal bending of a panel. The shear connectors 28 have sufficient strength and stiffness to allow a significant level of interaction between the concrete wythes 22, 24 in the resistance of normally expected loads. However, if the panel 20 is subjected to greater loads, it is possible for ends 36, 38 of the connector 28 to pivot slightly with respect to a connection point 40 in the plane of the connector 28. Any such motion or any other relative motion between different portions of the connector 28, allows small but discrete independent motions of the concrete wythes 22, 24. That independent motion of the concrete wythes 22, 24 can reduce the structural integrity of the composite panel 20. Thus, there is a need for a structural tie shear connector that is stiffer and stronger.

In another example, referring to FIG. 6, the connector 28 has a pair of anchors 30 that facilitate locating the connector 28 in the concrete wythe 24 during the manufacture of the concrete and insulation composite panel 20. The nominal size of the connector 28 is related to the nominal thickness of the panel as measured across the concrete wythes 22, 24 and the insulation 26. When a panel 20 is to be used in the construction of a building, it can be made in different nominal sizes, for example, 6 inches, 8 inches, 10 inches, 12 inches, etc. Thus, a different connector 28 must be made for each different thickness of the panel 20. Such a requirement generally increases costs from the manufacturer to the end user of the connector 28. Therefore, there is a need for a single structural tie shear connector that can be used with concrete and insulation composite panels of different sizes or thicknesses.

SUMMARY OF THE INVENTION

The present invention provides a structural tie shear connector that is stronger, more rigid, more reliable and has greater application flexibility than known connectors. The structural tie shear connector of the present invention permits a concrete and insulation composite panel to reliably react greater load forces without distortion, thereby improving the structural integrity of the panel. Further, the structural tie shear connector of the present invention can be used with concrete and insulation composite panels of different thicknesses; and thus, the connector has greater application flexibility and provides for reduced manufacturing and inventory costs.

According to the principles of the present invention and in accordance with the described embodiments, the invention provides a structural tie shear connector for use with a concrete and insulation composite panel. The panel has a first concrete wythe, a second concrete wythe, and an insulation layer interposed between the first and second concrete wythes. The connector has two sides extending in a direction substantially parallel to a longitudinal centerline of the connector and two sides extending across the longitudinal centerline of the connector. First and second pairs of angular links are connected to the sides, and a pair of legs are connected to, and extend outward from, one side of the connector. The connector is extendable through the insulation layer and into the first and second concrete wythes to hold the panel together. The two sides that cross the longitudinal centerline extend across a substantial width of the connector and function to stiffen and strengthen the connector.

In one aspect of this invention, the connector has another pair of legs that are connected to, and extend outwardly from, another side of the connector immediately adjacent the one side. The second pair of legs are also extendable into a concrete wythe. The connector has a substantially rectangular shape; and therefore, the two pairs of legs can be used with composite panels having different thicknesses.

In another embodiment, the invention provides a concrete and insulation composite panel having two concrete wythes with a layer of insulation interposed therebetween. The insulation layer has two insulation strips disposed side-by-side between the two concrete wythes to form a gap between the two insulation strips. Flexible foam is disposed in the gap between the two insulation strips. A structural tie shear connector is disposed in the gap against the flexible foam and extends into the first and second concrete wythes to hold the panel together. The flexible foam helps secure the structural tie shear connector in its desired location while the concrete wythes are being poured and cured; and in addition, the flexible foam fills the gap, so that the gap cannot be bridged by wet concrete.

These and other objects and advantages of the present invention will become more readily apparent during the following detailed description taken in conjunction with the drawings herein.

DETAILED DESCRIPTION OF THE INVENTION

Figure 1:
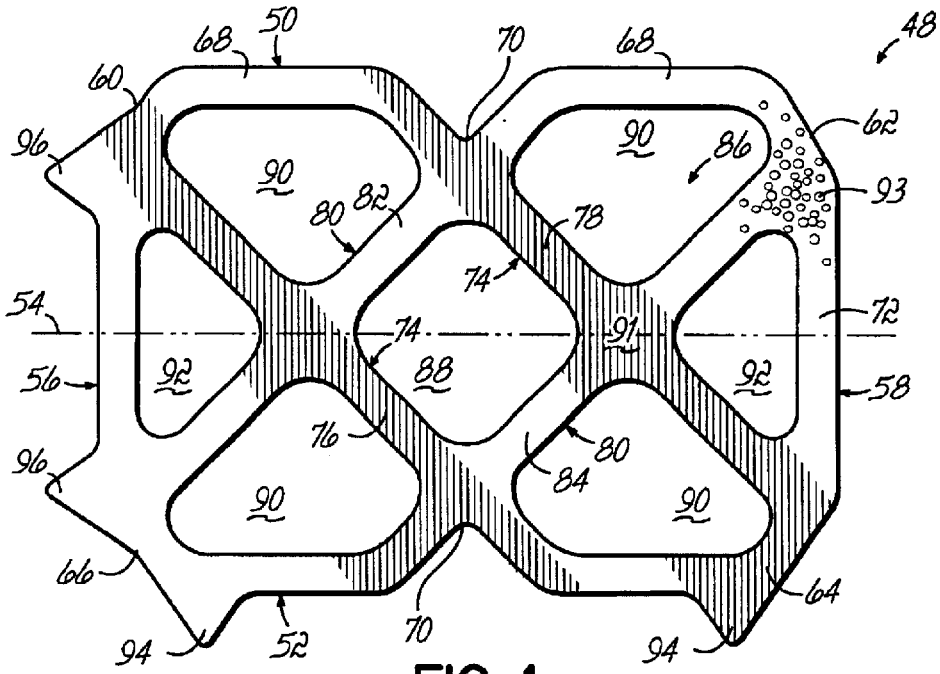
FIG. 1 is a front elevation view of a structural tie shear connector for use in a composite panel in accordance with the principles of the present invention.

Referring to FIG. 1, a structural tie shear connector 48 is comprised of two opposed longer sides 50, 52 that extend lengthwise or longitudinally and are connected by two opposed shorter sides 56, 58 that extend across a width of the connector 48. The respective first and second sides 50, 52 are substantially parallel to a longitudinal centerline 54 of the connector 48. The respective third and fourth sides 56, 58 extend across the longitudinal centerline 54. Ends of the first and second sides 50, 52 are connected to ends of the third and fourth sides 56, 58 at corners 60, 62, 64, 66. The first and second sides 50, 52 are comprised of two substantially straight links 68 that are separated by an indent or notch 70. The third and fourth sides 56, 58 are comprised of substantially straight links 72.

The connector 48 has a first pair 74 of internal angular links 76, 78 that extend in a first generally diagonal direction across the tie connector 48. The first angular link 76 extends between the corner 60 and the second side 52, and the second angular link 78 extends between the corner 64 and the first side 50. A second pair 80 of angular links 82, 84 extend in a second, opposite, generally diagonal direction across the connector 48. The third angular link 82 extends between the corner 66 and the first side 50, and the fourth angular link 84 extends between the corner 62 and the second side 52.

The sides 50, 52, 56, 58 and pairs of angular links 74, 80 form a plurality of fully enclosed openings or holes 86 within the periphery of the connector 48. The enclosed openings include a single center hole 88, four lateral holes 90 and two end holes 92. A first pair of legs 94 are located on one of the longer sides, for example, side 52; and a second pair of legs 96 are located on one of the shorter sides, for example, side 56.

The connector 48 is often made from a thermally nonconductive material such as a commercially available E-glass continuous fiber or a commercially available AR-glass continuous fiber. The connector is continuously wound on a mandrel and then impregnated and/or covered with a resin material. Referring to FIG. 1, the connector 48 has opposed major surfaces 91 that can have a wide ranges of textures from a relatively smooth texture to a very rough texture. Further, a texture on the surfaces 91 can be achieved in many ways, for example, projections or depressions on the surfaces 91 can be used to provide a desired texture as shown at 93. In addition, the pattern of the texture can be uniform or irregular. A rougher texture improves the bonding and interlocking of the connector 48 with concrete. The winding pattern is chosen so that the connector can be wound without breaking the fiber and so that the density of the fiber does not increase substantially at the various points of intersection of different links on the connector 48. The connector sides 50, 52, 56, 58 and pairs of angular links 74, 80 have a width of about 0.375 inches. Further, the connector 48 has a thickness in the range of about 0.063–0.100 inches or more. As will be appreciated, the width of the links and thickness of the connector can vary depending on expected connector loads and other design considerations.

Figure 2:
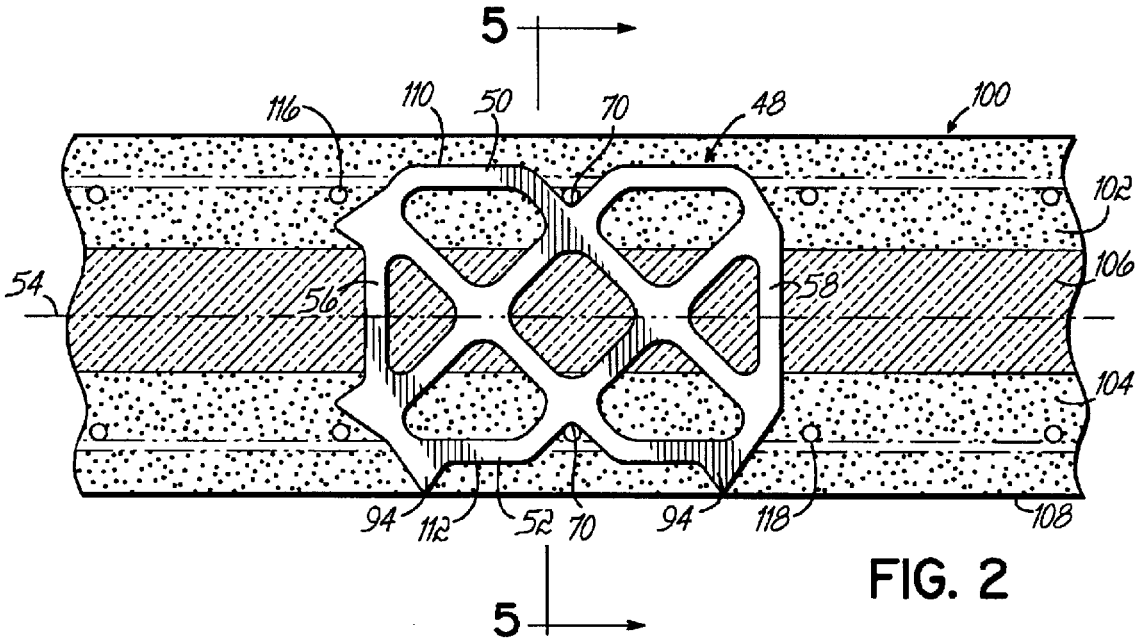
FIG. 2 is a cross-sectional view of one embodiment of a composite concrete panel using the structural tie shear connector of FIG. 1. For clarity, the flexible foam of FIG. 5 is not shown.

Referring to FIG. 2, the structural tie shear connector 48 is illustrated in one application, in which it is disposed within a composite panel 100 comprised of opposed layers or wythes of concrete 102, 104 that are separated by a layer of insulation 106. The legs 94 locate the tie connector 48 approximately one-half inch above an outer surface 108 of the concrete wythe 104. The tie connector 48 has a width exclusive of the legs 94, that is, a distance between the outer edges 110, 112 of the respective longer sides 50, 52, of about 5 inches. Therefore, when used with a composite panel 100 having a thickness of about 6 inches, the outer edge 110 of the longitudinal side 50 is about one-half inch from the outer surface 114 of the concrete wythe 102. The concrete wythes 102, 104 have respective patterns of rebar 116, 118. The notches or recesses 70 in the longer sides 50, 52 are dimensioned to allow a rebar to pass therethrough. The shorter sides 56, 58 extend across the longitudinal centerline 54 and substantially increase the stiffness and strength of the structural tie shear connector 48.

Figure 3:
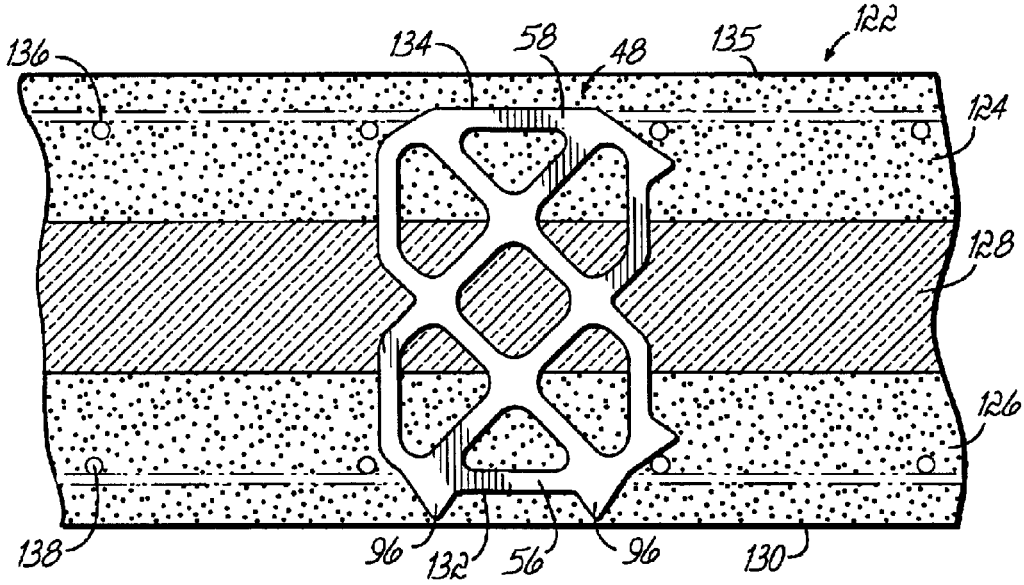
FIG. 3 is a cross-sectional view of another embodiment of a composite concrete panel using the structural tie shear connector of FIG. 1. For clarity, the flexible foam of FIG. 5 is not shown.

Referring to FIG. 3, the structural tie shear connector 48 can be used with a composite panel 122 that is about 8 inches thick. The composite panel 122 has opposed concrete wythes 124, 126 with an intervening insulation layer 128. In this application, the connector 48 is positioned within the panel 122 by locating ends of the second pair of legs 96 at an outer surface 130 of the concrete wythe 126. The tie connector 48 has a nominal length, that is, excluding the legs 96, a distance extending from an outer edge 132 of the third side 56 to the outer edge 134 of the fourth side 58, of about 7 inches. Therefore, since the legs 96 locate the edge 132 of the third side 56 about one-half inch from the surface 130 of the concrete wythe 126, the outer edge 134 of the fourth side 58 is located about one-half inch below the outer surface 135 of the concrete wythe 122. Therefore, the same structural tie shear connector 48 that is used with a composite panel 100 (FIG. 2) having a nominal thickness of about 6 inches can also be used with a composite panel 122 (FIG. 3) having a nominal thickness of about 8 inches. The patterns of rebar 136, 138 in the respective concrete wythes 124, 126 are normally connected in a lattice or grid forming squares having sides of about 6 inches. Thus, with a nominal width of about 5 inches, the connector 48 is able to be located inside a particular square or grid of the patterns of rebar 136, 138.

The process of manufacturing a concrete panel, for example, the concrete panel 100 of FIG. 2, will be described with respect to FIG. 4. First, one concrete wythe, for example, concrete wythe 104, is poured in a form 140. Next, while the concrete wythe 104 is still wet, a first strip of insulation material 106*a*, for example, a strip of rigid foam, is laid on top of the concrete wythe 104. Referring to FIG. 5, in one embodiment, a strip of nonrigid, flexible foam 150, for example, a piece of foam tape, having a thickness of about 0.25 inches is attached to a side wall 152*a* of the rigid foam strip 106*a*. The flexible foam can be either an open cell foam or a closed cell foam. In this embodiment, the flexible foam 150 is attached to one side of a backing tape 154 that has adhesive on its opposite side. Thus, the backing tape 154 can be easily applied to the side wall 152*a* of the foam strip 106*a*. As will be appreciated, in other embodiments, the flexible foam 150 may be attached to the side wall 152*a* via other known means. Further, in other embodiments, as will be appreciated, the flexible foam 150 is not required in order to use the connector of FIG. 1. It should be noted that for clarity, the flexible foam 150 has been eliminated from FIGS. 2 and 3.

Figure 4:
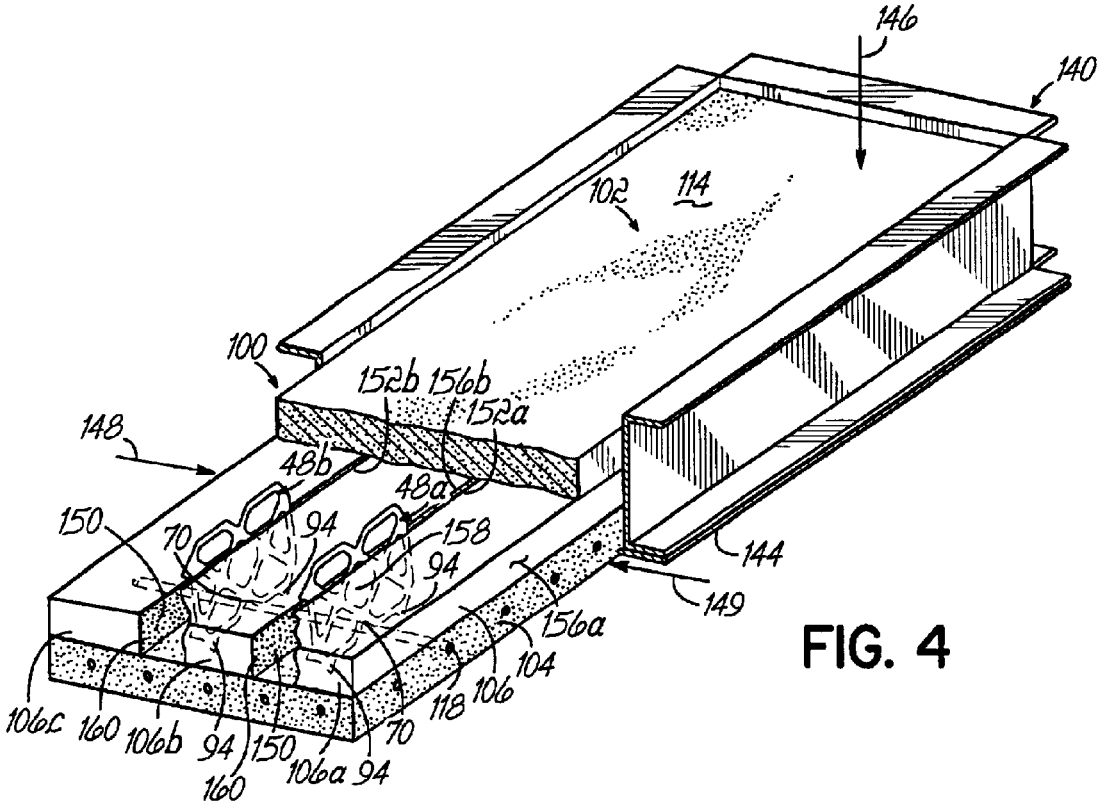
FIG. 4 is a partial perspective view illustrating the manufacture of a composite concrete panel using the structural tie shear connector of FIG. 1.
Figure 5:
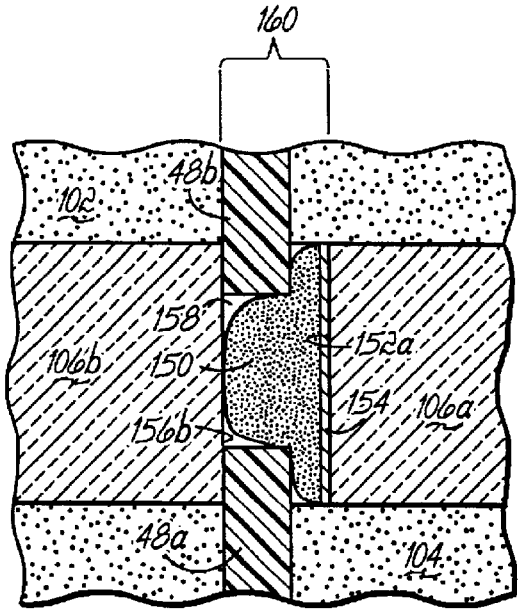
FIG. 5 is a cross-sectional view taken along line 5—5 of FIG. 2 and illustrates the seal between the foam layers of a composite concrete panel using the structural tie shear connector of FIG. 1.
Figure 6:
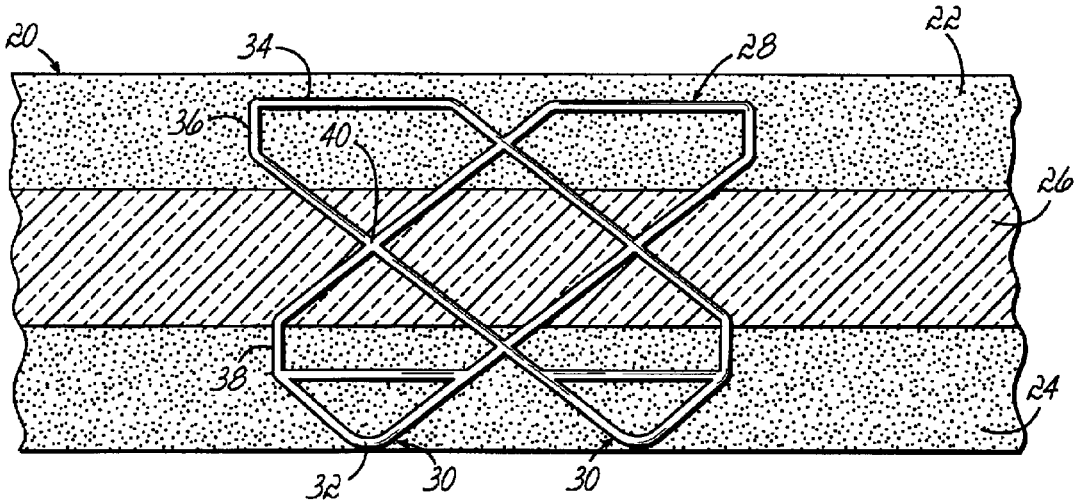
FIG. 6 PRIOR ART
FIG. 6 is a cross-sectional view of a composite concrete panel using a known structural tie shear connector.

Referring to FIG. 4, a row of tie shear connectors 48*a* are then positioned at desired longitudinal locations adjacent the side wall 152*a* of the first strip of insulation material 106*a*. Each of the connectors 48*a* is longitudinally positioned so that notch 70 is immediately above a piece of rebar 118. As will be appreciated, although a rebar 118 is illustrated in FIG. 4, in other applications, the connector 48*a* can be used without the rebar 118. Each of the connectors 48*a* is placed next to the flexible foam strip 150 (FIG. 5) and plunged into the wet concrete wythe 104 until the outermost ends of the legs 94 (FIG. 4) are located against an upper surface of the bottom plate 144 of the form 140. Thus, the legs 94 positively locate the tie connectors 48*a* at the proper location within the concrete wythe 104. Each of the connectors 48*a* is then pressed firmly against and seated in the flexible foam strip 150.

A second strip of insulation material 106*b* is then located over the concrete wythe 104; and opposite side 156*b* of the strip 106*b* is pressed firmly against the flexible foam strip 150 (FIG. 5) and the row of connectors 48*a*. In that process, the flexible foam strip 150 fills openings 158 within the connector 48*a*. As shown in FIG. 4, the second rigid foam strip 106*b* is pressed against the connectors 48*a* to minimize any gap 160 between the rigid foam strips 106*a*, 106*b*. Thereafter, a second row of connectors 48*b* is appropriately positioned on one side 152*b* of the insulation strip 106 and against a flexible foam strip (not shown) that is identical to the strip of flexible foam 150. A third insulation strip 106*c* is located with respect to the concrete wythe 104 in a manner similar to that described above with respect to insulation strips 106*a*, 106*b*.

The upper concrete wythe 102 is then poured over the insulation 106 and the tie connectors 48. The structural tie shear connectors 48 are firmly embedded in the flexible foam 150 in the gaps 160. Therefore, the flexible foam 150 helps secure and maintain the structural tie shear connectors 48 in their desired positions when the upper concrete wythe is being poured. Further, the flexible foam 150 covers the whole area of the side walls 152 of each of the insulation strips 106, and thus, fills and seals the gaps 160 separating the insulation strips 106*a*, 106*b*, 106*c*. In addition, the flexible foam 150 provides a divider or separation between the concrete layers 102, 104, thereby preventing any bridging between the concrete layers 102, 104 when either of the concrete layers is wet. When the concrete wythes 102, 104 have sufficiently solidified, the composite panel 100 is removed from the form 140.

When fully cured, the tie shear connectors 48 provide a strong and stiff structural connection between the concrete wythes 102, 104. The ultimate stiffness and strength of the composite panel 100 is a function of the number of connectors 48 used in its manufacture. The greater the number of connectors 48, the greater the capability of the composite panel 100 to react forces in a first direction 146 normal to the outer surfaces 108, 114 of the respective concrete wythes 102, 104 as well as shear forces that are in directions 148, 149 that are substantially parallel to the outer surfaces 108, 114.

The structural tie shear connector 48 is stronger, stiffer, more reliable and has greater application flexibility than known connectors. When the connector 48 is used as illustrated in FIG. 2, the shorter sides 56, 58 not only contribute significantly to improving the stiffness of the connector 48 but also provide redundant load paths. In addition, the shorter sides 56, 58 provide connecting paths with the longer sides 50, 52 and the angular links 74, 80 and thus, facilitate the fiber winding process in the manufacture of the tie connector 48.

The second pair of legs 96 also permit the same structural tie shear connector 48 to be used with composite panels that have different thicknesses. As described above, the connector 48 can be used with a panel 100 (FIG. 2) having a thickness of about 6 inches as well as the panel 122 (FIG. 3) having a thickness of about 8 inches. The presence of the shorter sides 56, 58 that extend fully across the width of the connector 48 also provides enclosed openings or end holes 92. The end holes 92 capture concrete in the wythes 124, 126 and are effective to provide a more secure and stable connection between the connector 48 and the concrete wythes 124, 126. Such an improved connection further adds to the ability of the tie connector 48 to improve the strength and stiffness of the composite panel 122. By having a single connector 48 that can be used with two different composite panels 100, 122, the inventory of different connectors is substantially reduced, thereby providing a corresponding reduction in costs from manufacturing to end use of the connector.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described embodiment, absent the legs 94, 96, the tie connector 48 is about 5 inches wide and about 7 inches long. Thus, the connector can be used with composite panels that are either 6 or 8 inches thick.

It is common to manufacture composite panels of other thicknesses, for example, about 10 inches and 12 inches. To accommodate such panels, a connector can be provided that is geometrically similar to the connector 48, but absent its legs, is about 9 inches wide and 11 inches long. Alternatively, connectors can be made that are about 7 inches wide and 9 inches long. Thus, the size of the connector will vary depending on its application.

In the described embodiment with respect to FIG. 5, a flexible foam strip 150 is attached to a side wall 152*a* of an insulation strip 106*a*. As will be appreciated, in an alternative embodiment, a second flexible foam strip can also be attached to the side wall 156*b* of the insulation strip 106*b*. Thus, when the insulation strips 106*b* is placed against insulation strip 106*a*, the use of two flexible foam strips provides an even better seal.

Therefore, the invention in its broadest aspects is not limited to the specific details shown and described. Consequently, departures may be made from the details described herein without departing from the spirit and scope of the claims which follow.

What is claimed is:

1. A structural tie shear connector for use with a concrete and insulation composite panel having a first concrete wythe, a second concrete wythe, and an insulation layer interposed between the first and second concrete wythes, the connector comprising:

a plurality of sides comprising
first and second opposed longer sides, and
opposed first and second shorter sides;

a first pair of angular links extending across the connector in a first direction and connected to the sides;

a second pair of angular links extending across the connector in a second direction and connected to the sides, one of the first pair of links, one of the second pair of links and the first shorter side forming only one, enclosed, triangular first end opening substantially centrally located between the longer sides and with respect to the first shorter side, and another of the first pair of links, another of the second pair of links and the second shorter side forming only one, enclosed, triangular second end opening substantially centrally located between the longer sides and with respect to the second shorter side; and a pair of legs connected to and extending outward from one of the longer and shorter sides of the connector, the connector adapted to be extendable through the insulation layer and into the first and second concrete wythes to hold the panel together.

2. The tie shear connector of claim 1 further comprising another pair of legs connected to, and extending outwardly from, another of the longer and shorter sides of the connector immediately adjacent the one of the longer and shorter sides.

3. The tie shear connector of claim 2 wherein the two longer sides are substantially parallel.

4. The tie shear connector of claim 3 wherein the two shorter sides are substantially parallel.

5. The tie shear connector of claim 4 wherein the two longer sides are substantially perpendicular to the two shorter sides.

6. The tie shear connector of claim 5 wherein each of the two longer sides is comprised in part of two substantially straight links.

7. The tie shear connector of claim 6 wherein each of the two shorter sides is comprised in part of a substantially straight link.

8. The tie shear connector of claim 7 wherein the first pair of angular links extend in a first generally diagonal direction with respect to the sides of the connector.

9. The tie shear connector of claim 8 wherein the second pair of angular links extend in a second generally diagonal direction with respect to the sides of the connector.

10. The tie shear connector of claim 9 wherein angular links of the first pair of angular links are substantially parallel.

11. The tie shear connector of claim 10 wherein angular links of the second pair of angular links are substantially parallel.

12. The tie shear connector of claim 1 wherein the two longer sides and the two shorter sides form a substantially rectangular perimeter.

13. The tie shear connector of claim 1 wherein the connector is made from a thermally nonconductive material.

14. The tie shear connector of claim 1 wherein the connector further comprises opposed major surfaces having a rough texture.

15. A structural tie shear connector for use with a concrete and insulation composite panel having a first concrete wythe, a second concrete wythe, and an insulation layer interposed between the first and second concrete wythes, the connector comprising:

only six substantially straight first links forming sides of a substantially rectangular perimeter of the connector, wherein at least one side of the substantially rectangular perimeter is formed by two substantially colinear straight first links;

a first pair of angular links extending in a first direction and having ends connected to the first links;

a second pair of angular links having ends connected to the first links; and a pair of legs connected to and extending outwardly from one side of the connector, the connector is adapted to be extendable through the insulation layer and into the first and second concrete wythes to hold the panel together.

16. The tie shear connector of claim 15 wherein each of the first links is substantially colinear or substantially perpendicular to others of the first links.

17. The tie shear connector of claim 16 wherein the first links are connected substantially end to end to form the substantially rectangular perimeter of the connector.

18. The tie shear connector of claim 15 further comprising another pair of legs connected to, and extending outwardly from, another side of the connector immediately adjacent the one side and adapted to be extendable into one of the concrete wythes.

19. A structural tie shear connector for use with a concrete and insulation composite panel having a first concrete wythe, a second concrete wythe, and an insulation layer interposed in a gap between the first and second concrete wythes, the connector comprising:

a plurality of substantially straight first links forming sides of a substantially rectangular perimeter of the connector;

a first pair of angular links having ends connected to the first links;

a second pair of angular links having ends connected to the first links, the angular links and the first links forming only seven fully enclosed openings in the connector; and a first pair of legs connected to and extending outwardly from one side of the connector, a second pair of legs connected to and extending outwardly from another side of the connector immediately adjacent to the one side, wherein, the connector is adapted to be extendable through the gap and into the first and second concrete wythes to hold the panel together.

20. The tie shear connector of claim 19 wherein each side of the substantially rectangular perimeter being formed by at least one of the straight first links.

21. The tie shear connector of claim 19 wherein two first links form opposed sides of the connector, and the two first links and the angular links form two enclosed triangular end openings in the connector.

22. The tie shear connector of claim 19 wherein the first links are connected substantially end to end to form the substantially rectangular perimeter of the connector.

23. A concrete and insulation composite panel, comprising:

a first concrete wythe;

a second concrete wythe;

a plurality of insulation strips disposed side-by-side between the first and second concrete wythes to form a plurality of gaps, each gap being formed between adjacent ones of the insulation strips;

a plurality of flexible foam strips, each of the plurality of flexible foam strips disposed in a different one of the gaps between the adjacent ones of the insulation strips; and a plurality of rows of structural tie shear connectors, each row of structural tie shear connectors being disposed in a different one of the gaps and against a different one of the flexible foam strips, and each structural tie shear connector in each of the plurality of rows of structural tie shear connectors extending into the first and second concrete wythes to hold the panel together.

24. The concrete and insulation composite panel of claim 23 wherein the plurality of insulation strips is comprised of rigid foam strips.

25. A concrete and insulation composite panel, comprising:

a first concrete wythe;

a second concrete wythe;

an insulation layer interposed between the first and second concrete wythes;

a structural tie shear connector extending through the insulation layer and imbedded into the first and second concrete wythes to hold the panel together, the connector comprising two sides extending in a first direction substantially parallel to a longitudinal centerline of the connector;

two sides extending in a second direction substantially perpendicular to, and crossing, the longitudinal centerline of the connector;

a first pair of angular links connected to the sides;

a second pair of angular links connected to the sides;

a first pair of legs connected to and extending outward from one side of the connector and into one of the concrete wythes; and a second pair of legs connected to, and extending outwardly from, another side of the connector immediately adjacent the one side and adapted to be extendable into one of the concrete wythes.

26. The concrete and insulation composite panel of claim 25 wherein the two sides extending in the second direction and the angular links for two enclosed triangular end openings in the connector.

27. The concrete and insulation composite panel of claim 25 wherein the connector is made from a thermally nonconductive material.

28. The concrete and insulation composite panel of claim 25 wherein the insulation layer has a gap therethrough in communication with the first and second concrete wythes and the connector extends though the gap.

29. A concrete and insulation composite panel, comprising:

a first concrete wythe;

a second concrete wythe;

two insulation strips disposed side-by-side between the first and second concrete wythes to form a gap between the two insulation strips;

flexible foam disposed in the gap between the two insulation strips; and a structural tie shear connector disposed in the gap against the flexible foam and extending into the first and second concrete wythes to hold the panel together.

30. The concrete and insulation composite panel of claim 29 wherein the insulation strips are comprised of rigid foam strips.

* * * * *